US005816174A

United States Patent [19]

Smith et al.

[11] Patent Number: 5,816,174

[45] Date of Patent: Oct. 6, 1998

[54] ISLAND PAYMENT TERMINAL MOUNTING SYSTEM

[76] Inventors: Ervin M. Smith, 530 N. 200 West, Monroe, Ind. 46772; John A. Todd, 5214-2 Stonehedge Blvd., Fort Wayne, Ind. 46835; Dennis K. Troy, 7515 Antebellum Blvd., Fort Wayne, Ind. 46815; Phillip L. Brookshire, 808 Ludlow Ave., Cincinnati, Ohio 45220

[21] Appl. No.: 690,589

[22] Filed: Jul. 25, 1996

[51] Int. Cl.[6] ..... E05G 1/00

[52] U.S. Cl. ..... 109/56; 109/51

[58] Field of Search ..... 109/22, 23, 24, 109/50, 51, 78, 79, 56, 57; 52/27.5, 27–40; 902/29, 30, 31, 32, 33, 34, 35, 41; 40/607

[56] References Cited

U.S. PATENT DOCUMENTS

| | | | |
|---|---|---|---|
| 1,291,823 | 1/1919 | Fuller | 52/40 |
| 1,851,046 | 3/1932 | Horni | 40/607 |
| 2,625,762 | 1/1953 | McColl | 40/607 |
| 2,899,764 | 8/1959 | Oberlin, Jr. | 40/607 |
| 3,950,874 | 4/1976 | Diggs | 40/607 |
| 4,262,439 | 4/1981 | Dinan et al. | 40/607 |
| 4,282,424 | 8/1981 | Hirose | 902/32 |
| 4,615,280 | 10/1986 | Shoop et al. | 109/50 |
| 4,967,366 | 10/1990 | Kaehler | 364/479 |
| 5,224,675 | 7/1993 | Ellenberger et al. | 248/183 |
| 5,269,367 | 12/1993 | Susa et al. | 165/41 |
| 5,340,969 | 8/1994 | Cox | 235/381 |
| 5,500,890 | 3/1996 | Rogge et al. | 379/91 |
| 5,596,934 | 1/1997 | Hamm et al. | 109/50 |

OTHER PUBLICATIONS

Tokheim's CS5000 Fleet Fueling System, Oct. 1988, Form No. 439.

Tokheim's Bulletin No. 100R3, CS6000 Series, Nov. 1984, Form No. 100R3.

*Primary Examiner*—Steven N. Meyers
*Assistant Examiner*—Tuyet-Phuong Pham
*Attorney, Agent, or Firm*—Doreen J. Gridley; Ice Miller Donadio & Ryan

[57] ABSTRACT

Automated attendant terminals and a mounting system for such terminals. Each attendant terminal is substantially L-shaped and comprises a housing formed by front, opposing side, rear, and first and second contact surfaces. The first and second contact surfaces form the recessed portion of the L-shape. When used in connection with the mounting system of the present invention, the first contact surfaces and/or the second contact surfaces of each terminal contacts the surfaces of the support mechanism (such as a pole) to result in a "back-to-back" orientation of the terminals. The support mechanism includes opposing surfaces for such engagement with the contact surfaces of the terminals. The mounting system also includes an attachment mechanism which connects the terminals to the poles in this orientation. The attachment mechanism is only accessible through the interior of the housings of the terminals to thereby provide a secure island automated attendant terminal system.

17 Claims, 5 Drawing Sheets

ISLAND PAYMENT TERMINAL MOUNTING SYSTEM

FIELD OF THE INVENTION

This invention relates to mounting systems, and, in particular, to a system for securely mounting multiple island payment terminals.

BACKGROUND OF THE INVENTION

Over the last few decades, computerized or automated attendant systems have evolved to handle repetitive transactions previously handled by a human attendant. A few of the more common examples of these automated attendants include automated teller machines (ATMs) used to handle common banking transactions formerly handled by a bank teller, and automated payment terminals (APTs) as are found in gasoline stations and which handle payment for fuel pumped by the customer. Payment for fuel had formerly been handled by the station attendant. ATMs and APTs are not only advantageous in reducing personnel costs, but may also result in greater safety for personnel employed since businesses such as banks and gasoline stations are often a target of theft or robbery. Further, the utilization of ATMs and APTs permit customers to engage in transactions handled by the automated attendant around-the-clock, or at least for longer hours, when the use of human attendants may render such extended hours impractical or unprofitable.

Because automated attendants usually contain (or may contain) a significant amount of cash, sufficient security measures must be taken to prevent and discourage theft of the contents of the automated attendant. One common security measure used for ATMs is to mount the ATM in a solid (such as concrete) wall or to house the ATM in what is essentially a small building. Not only is such installation time consuming to build and costly as to materials, it is not practical in all situations.

Consider, for example, the APT installed at a gasoline station. Often, space is at a premium, for the station desires to accommodate as many cars (and thus fuel pumps) as is necessary to handle the station's peak business periods without causing undue delay. In this regard, islands of fuel pumps are usually employed by the station. The island approach also reduces the cost of attaching pumps to the fuel tanks, and serves to locate the fuel at a safe distance from the station.

Permanent installation may make repair difficult and expensive to perform. Further, no mechanism is provided in permanent installations to accommodate an automated attendant of a different configuration. For example, it is possible that other features may be added to future automated tellers, new technology may permit the automated teller to be of small dimensions, or, future models of the automated teller may be redesigned for aesthetic reasons, causing considerable problems when an old unit is to be replaced with a new unit.

Additionally, for an APT, the products supported may change so as to result in a need to modify the APT. For example, at present three grades of gasoline are often made available. It is conceivable that this number could change requiring a larger or smaller unit to accommodate additional or fewer fuel pumps.

Therefore, it is desired to provide a mounting system for automated attendant machines which do not require permanent installation in a wall or in a separate building or housing created specifically for the automated attendant. It is also desired to provide such a mounting system whereby two or more automated attendants are grouped together to permit customers to use each of the grouped automated attendants simultaneously, such as in the traditional island arrangement used at gasoline stations. The island arrangement permits two customers, one on each side of the island, to use the two back-to-back positioned sets of fuel pumps with accompanying automated attendants.

It is further desired to provide a mounting system whereby the system is able to accommodate groups of automated attendants of differing configurations, either as a group or within the group. It is also desired to provide such a mounting system which permits for inexpensive repair or replacement of an automated attendant in the group.

Of course, as previously stated, the desired mounting system for automated attendants must not compromise the security of the contents. Appropriate measures must be provided to prevent unauthorized access in a cost-effective manner, and must also permit access to authorized personnel without being unduly burdensome or awkward.

SUMMARY OF THE INVENTION

The present invention provides an island payment terminal system which supports two payment terminals in a back-to-back orientation. The payment terminals are mounted in manner to secure the contents of the payment terminal, including any cash or valuable information about customer's credit or debit cards which are housed in the payment terminal. These objectives and other advantages are realized without requiring installation of the payment terminals into a permanent wall or building.

The payment terminal system includes L-shaped payment terminals. Each payment terminal has a housing. The housing is formed by a front surface, first and second side surfaces, rear surface, and first and second contact surfaces. The first and second contact surfaces are those which form the recessed portion of the L-shaped housing. The system also includes a means for supporting the first and second payment terminals. The support means has at least two surfaces for partial engagement with either the first or second contact surface of the first terminal and for partial engagement with either the first or second surface of the second contact surface of the second terminal. Further, the system includes a means for mounting the first and second payment terminals to the support means. When the terminals are mounted to the support means, the front surfaces of the terminals face in opposite directions to result in a "back-to-back" orientation of the terminals.

The present invention may be used for payment terminals such as are used at gasoline pumps at gasoline stations or vacuum stations as are used at self-serve car washes. Further, the terminals may comprise ATMs which are not associated with any good or service other than the transactions which the ATM can handle. Because the mounting means is disposed within and only accessible through the interior of the housings of the terminals, the system is secure. Also, repair and replacement of the terminal or any part thereof is much easier and less expensive than permanent installations, such as when the terminal is installed within a wall or a permanent building. The mounting system also permits the use of terminals of various configurations—both as to size of the terminal and the number and type of transactions handled by the terminal.

The above-discussed features, as well as additional features and advantages of the present invention, will become readily apparent by reference to the following detailed description and the accompanying drawings.

DETAILED DESCRIPTION

Figure 1:
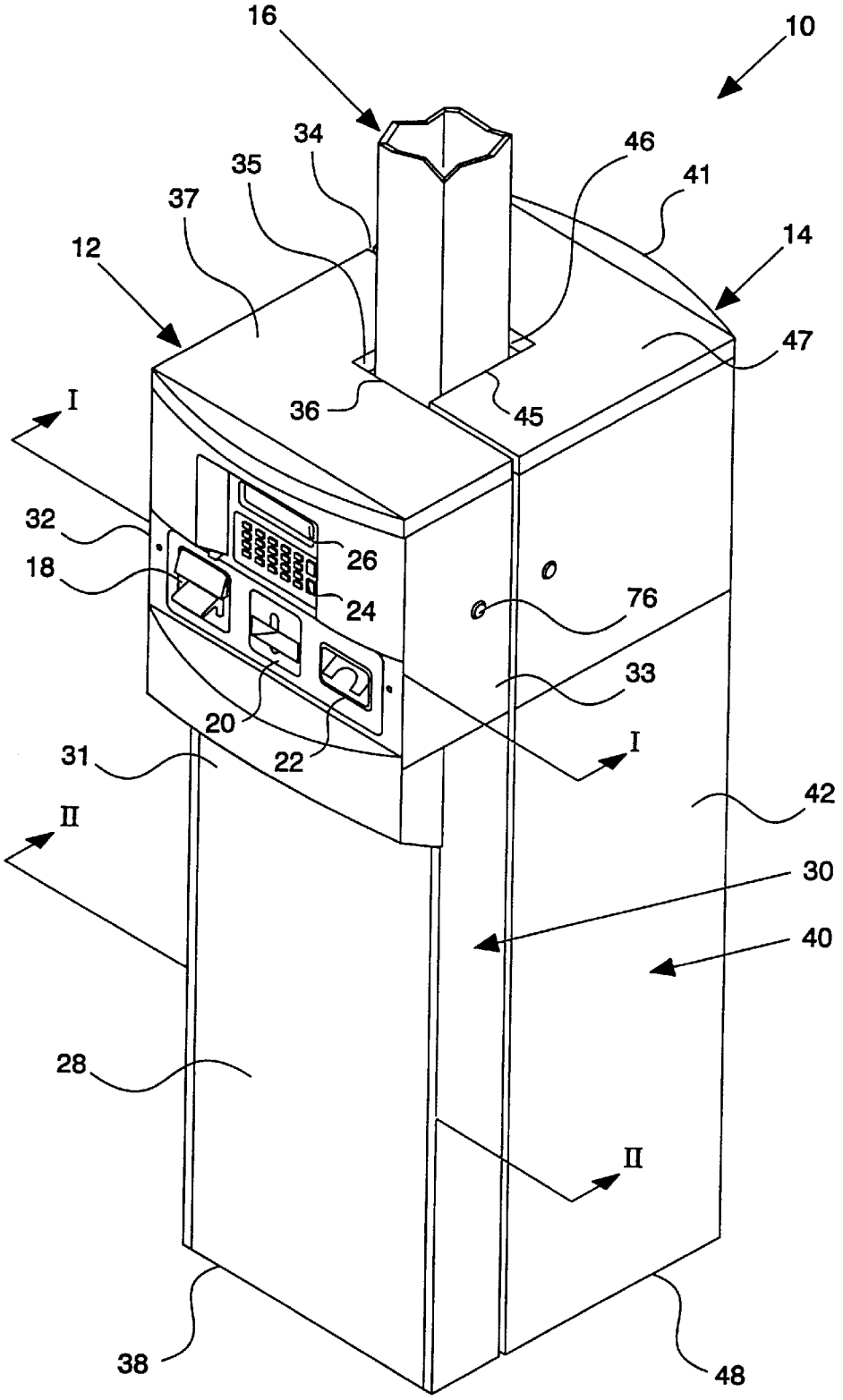
FIG. 1 shows a perspective view of one embodiment of the automated attendant system of the present invention in which two payment terminals are mounted to a single support pole.

Referring now to FIG. 1, there is shown a perspective view of one embodiment of the automated attendant system of the present invention in which two payment terminals are mounted to a single support in accordance with the mounting system of the present invention. Specifically, in this embodiment automated attendant system 10 comprises first and second payment terminals 12 and 14, respectively, each mounted to pole 16 which serves as a support means for first and second terminals 12 and 14.

For illustration purposes only, first and second payment terminals 12 and 14 in this embodiment comprise automated payment terminals for use at gasoline stations in an island arrangement whereby one customer may utilize first terminal 12 simultaneously while another customer may utilize second terminal 14. As shown in FIG. 1, first terminal 12 includes on the upper portion thereof means for receiving cash 18, means for receiving and reading a credit or debit card 20, means for printing a receipt 22, data entry means 24, and display means 26. Lower portion 28 of first terminal 12 may have attached thereto several fuel nozzles (not shown) for use by the customer to pump gasoline therefrom. Of course, control of such fuel nozzles is operatively connected to cash receiving means 18, credit card receiving means 20, printing means 22, data entry means 24, and display means 26 by means well known in the art. First and second terminals 12 and 14 are identical in this embodiment, but need not be. For example, second terminal 14 may comprise a different number of fuel nozzles, or may not include cash receiving means 18 such that only credit transactions may take place at second payment terminal 14.

Figure 2:
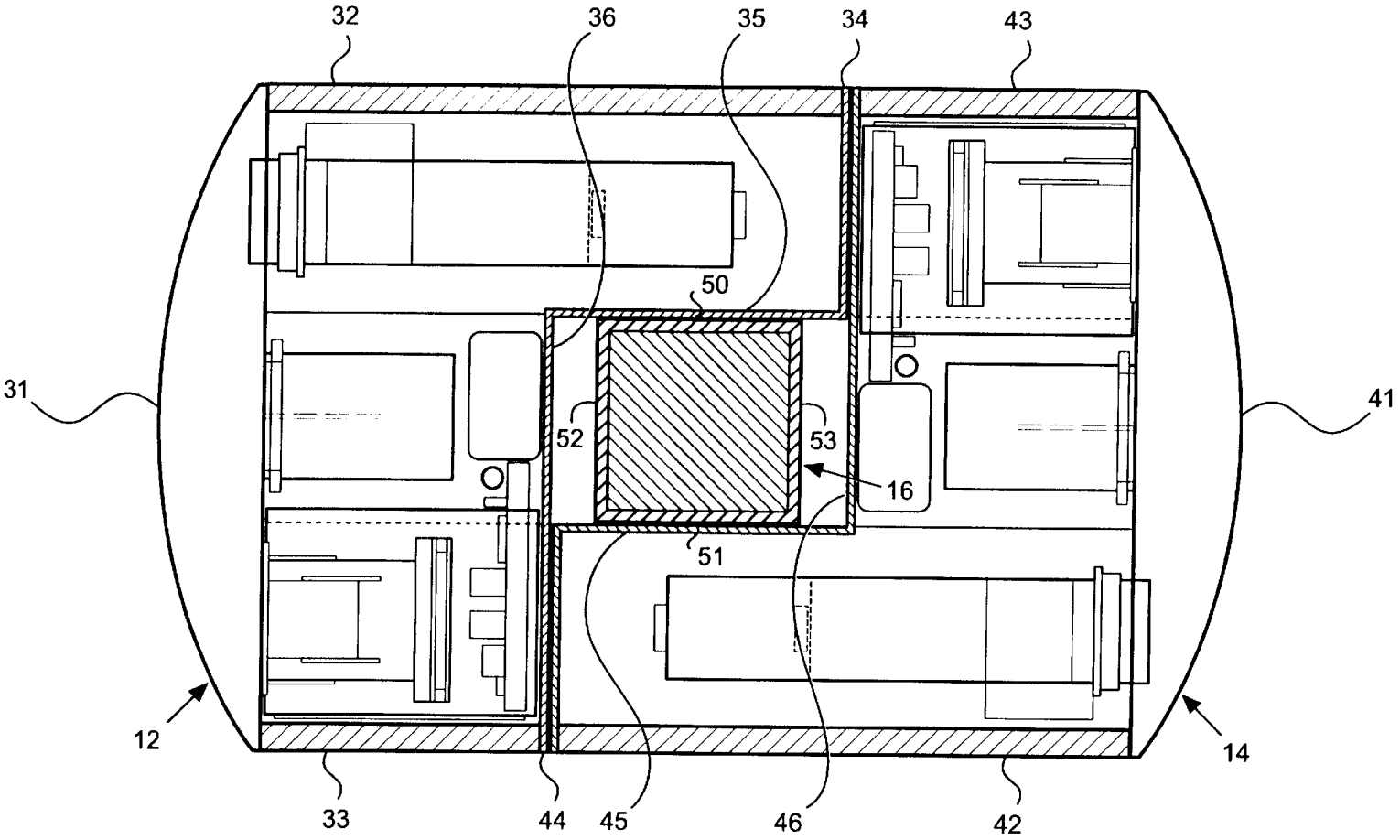
FIG. 2 shows a cross-sectional view of the embodiment of FIG. 1 at line I—I.

As seen in FIGS. 1 and 2, first and second payment terminals 12 and 14 each comprise a substantially L-shaped housing 30 and 40, respectively. Housing 30 of first terminal 12 comprises front surface 31, first and second side surfaces 32 and 33, respectively, rear surface 34, and first and second contact surfaces 35 and 36, respectively. First and second contact surfaces 35 and 36 for the recessed portion of L-shaped housing 30. Housing 30 of first terminal 30 also comprises top surface 37 and bottom surface 38. Similarly, housing 40 of second payment terminal 14 comprises front surface 41, first and second side surfaces 42 and 43, respectively, rear surface 44, first and second contact surfaces 45 and 46, respectively, top surface 47, and bottom surface 48.

FIG. 2 shows a cross-sectional view of the embodiment of FIG. 1 at line A—A. In this embodiment, support pole 16 comprises a square hollow pole having two sets of opposing surfaces—specifically one set comprises first and second surfaces 50 and 51, and another set comprises third and fourth surfaces 52 and 53. When first and second payment terminals are mounted to pole 16 as illustrated in this FIG. 2 and as described in association with FIGS. 3 and 4, a portion of first contact surface 35 of first payment terminal 12 contacts first surface 50 of pole 16, and a portion of first contact surface 45 of second payment terminal 14 contacts second surface 51 of pole 51. In this manner, front surface 31 of first payment terminal 12 faces in the opposite direction of front surface 41 of second payment terminal 14. In other words, when mounted on pole 16, first and second payment terminals 12 and 14 are oriented back-to-back. Note that in this embodiment second contact surfaces 36 and 46 of first and second payment terminals 12 and 14 do not engage third and fourth surfaces 52 and 53 of pole 16.

Figure 3:
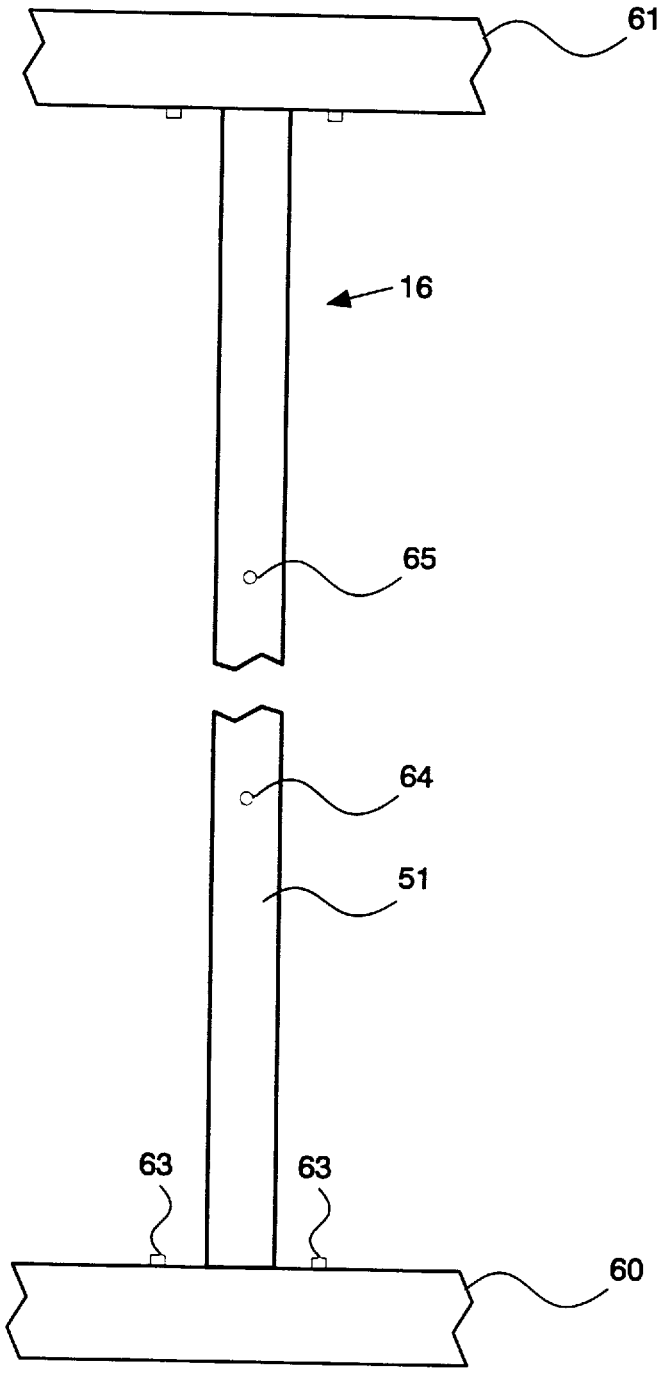
FIG. 3 shows a side view of one embodiment of the support pole of the present invention.

Referring now to FIG. 3, there is shown a side view of the support pole of the mounting system of the present invention. Specifically, first surface 51 of pole 16 is illustrated. Pole 16 is rigidly, and perhaps permanently, affixed to ground surface (and horizontal surface) 60 by means well known in the art so that pole 16 extends vertically therefrom. In this embodiment, pole 16 is also rigidly affixed to upper ceiling 61 to provide additional stability for the vertical orientation of pole 16.

Figure 4:
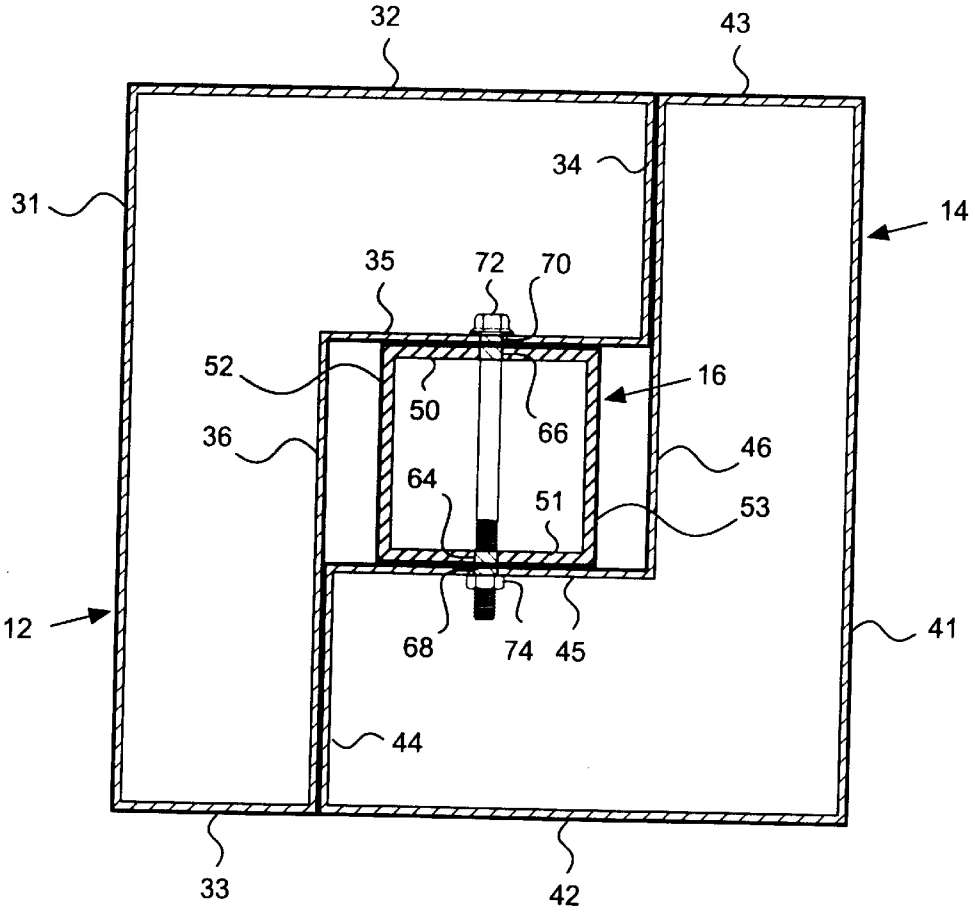
FIG. 4 shows a cross-sectional view of the embodiment of FIG. 1 at line II—II.

Formed in second side 51 of pole 16 are holes 64 and 65 for receipt of a fastener as is described in greater detail herein in connection with FIG. 4. Extending above ground surface 60 are pins 63. Pins 63 are optional, but may provide additional stability for a payment terminal mounted to pole 16, and may also assist in aligning a payment terminal in position with respect to pole 16. These advantages are realized when properly positioned recesses of slightly larger dimensions than pins 63 are formed in the bottom surface of a payment terminal, or if pins 63 are positioned to be exposed just outside the outer dimensions of the bottom portion of the housing, for example.

FIG. 4 shows a cross-sectional view of the embodiment of FIG. 1 at line B—B and illustrates the means by which payment terminals are mounted to the support means. Formed in first and second opposing surfaces 50 and 51 of pole 16 are first and second holes 66 and 64, respectively. Formed within first contact surface 35 of housing 30 of first payment terminal 12 is first aperture 70, and formed within first contact surface 45 of housing 40 of second payment terminal 14 is second aperture 68. First and second apertures 70 and 68 are positioned to permit a fastener to extend through first aperture 70, first hole 66, second hold 64 and second aperture 68. In this embodiment, the fastener comprises threaded bolt 70 having nut 74 threaded thereon.

When nut 74 is tightened, a portion of first contact surface 35 of housing 30 of first payment terminal 12 engages first surface 50 of pole 16. Similarly, a portion of first contact surface 45 of housing 40 of second payment terminal 14 engages second surface 51 of pole 16. As indicated in FIG. 3, more than one fastener may be desired to provide additional support for mounting first and second payment terminals 12 and 14 to pole 16.

It will be appreciated by those of skill in the art that first and second apertures 70 and 68, when payment terminals 12 and 14 are mounted as shown in FIG. 4, are only accessible from the interior of housings 30 and 40. Because housings 30 and 40 may be made secure from unauthorized access (as by the provision of a locking means identified in FIG. 1 as item 76 on housing 30), a cost-effective, secure mounting means is provided by the present invention without requiring that the payment terminal be installed in a permanent wall or in a separate building. Further, repair or replacement of an entire payment terminal or only a component thereof is made easy and less expensive by use of the mounting system. Also, flexibility is provided in supporting terminals of various configurations together.

It will also be appreciated that the present mounting system can be used for payment terminals used in connection with goods or services other than gasoline. For example, the mounting system of the present invention may be used with vacuum systems found at self-serve car wash stations. It will be further appreciated that the mounting system can be used to support other automatic attendant systems such as ATMs. By using such an "island" mounting system, ATM traffic (automobile and/or pedestrian traffic) could access two ATMs simultaneously without consuming considerable driveway or floor space.

Those skilled in the art will also recognize that the fastener used in the present invention need not comprise a single bolt and nut combination as illustrated in FIG. 4. Two nut and bolt combinations may be used (one to attach one terminal to the pole and another to attach the other terminal to the pole). Further, other types of fasteners, such as pins and stops are contemplated to be within the scope of the invention.

Figure 5A:
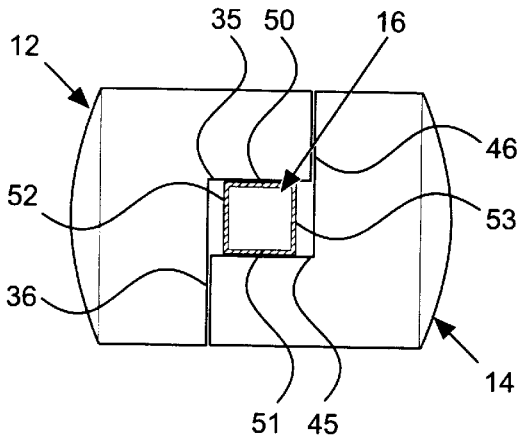
FIGS. 5A, 5B, and 5C show top views of three embodiments of the mounting system of the present invention in which identical payment terminals are mounted on poles of three different sizes, respectively.
Figure 5B:
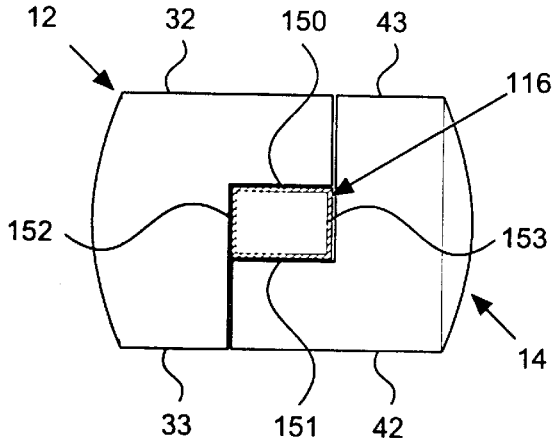
Figure 5C:
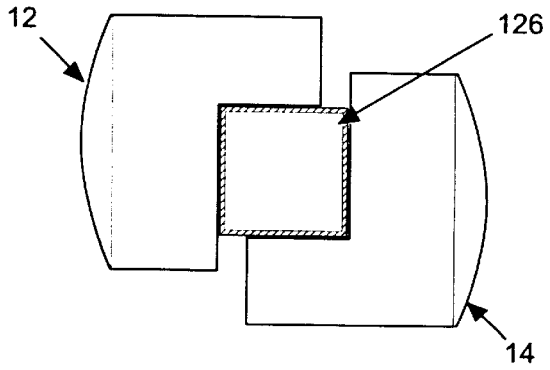

Referring now to FIGS. 5A, 5B and 5C, there are shown top views of three embodiments of the mounting system of the present invention in which the same two payment terminals are mounted on poles of three different sizes. FIG. 5A shows pole 16 of the embodiment of FIGS. 1–4 which is 6"×6" in exterior dimensions. When first and second terminals 12 and 14 are aligned such in the configuration shown (35, 36, 45 and 46), the gap between the first and second contact surfaces of each terminal 12 and 14 is 6"×8". For this reason, a portion of first contact surface 35 of first terminal 12 contacts the entire first surface 50 of pole 16, a portion of first contact surface 45 of second terminal 14 contacts the entire second surface 51 of pole 16, while a gap remains between second contact surface 36 of first terminal 12 and third surface 52 of pole 16, and a gap remains between second contact surface 46 of second terminal 14 and fourth surface 53 of pole 16.

For the embodiment of FIG. 5B, pole 116 is 8" by 8". Thus, the entire first surface 150 of pole 116 contacts first contact surface 35 of first terminal 12, the entire second surface 151 of pole 116 contacts first contact surface 45 of second terminal 14, the entire third surface 152 of pole 116 contacts second contact surface 36 of first terminal 12, and the entire fourth surface 153 of pole 116 contacts second contact surface 46 of second terminal 14. However, first side surface 32 of first terminal 12 no longer resides in the same place as second side surface 43 of second terminal 14, and, of course, the second side surface 33 of first terminal 12 is offset from the first side surface 42 of second terminal 14.

In the embodiment of FIG. 5C, pole 126 is 10"×10". Because both dimensions of pole 126 are greater than the 6"×8" gap created between aligned terminals 12 and 16, the contact surfaces of terminals 12 and 14 only contact a portion of each of the first, second, third and fourth surfaces of pole 126.

FIGS. 5A, 5B, and 5C illustrate that there does not need to be an exact matching of the outer dimensions of the pole and the gap formed by the contact surfaces of the terminals when the side surfaces of the terminals are aligned. Further, it is contemplated and within the scope of the invention that a fastener may extend through either or both sets of opposing side surfaces of the pole. It is preferred, although not required, however, that the fastener extend through the contact surfaces of the terminals which engage the surfaces of the pole. Thus, the mounting system of the present invention permits for the installation of the L-shaped payment terminals disclosed herein on existing poles.

Those skilled in the art will also appreciate that the surfaces of the housing of the payment terminals, including the contact surfaces, and the surfaces of the support means (pole) do not have to be flat as illustrated. It is desirable, however, to match at least a portion of the contact surfaces of the terminals with a portion of the surfaces of the pole so that the terminals are securely mounted to the pole.

As used herein and in the claims, the term "payment terminal" is not limited to a payment terminal having the same purpose or functions described herein. Rather, the term "payment terminal" refers to an automated attendant such as ATMs or ATPs used in connection with a variety of goods or services.

It will be appreciated that the above embodiments are merely illustrative and that those of ordinary skill in the art may readily envision or develop other embodiments that incorporate the principles of the present invention and fall within the scope and spirit hereof.

We claim:

1. An automated attendant system comprising:

first and second automated terminals in proximity to each other, the first and second automated terminals each comprising an housing having front, first and second side, rear, and first and second contact surfaces forming a substantially L-shaped housing, the first and second contact surfaces comprising the recessed portion of the L-shaped housing;

support means for supporting the first and second terminals, the support means having at least first and second surfaces in partial engagement with the first or second contact surface of the first terminal and with the first or second surface of the second contact surface of the second terminal; and mounting means for mounting the first and second terminals to the support means such that the front surfaces of the housings of the terminals face in opposite directions.

2. The system of claim 1, wherein the mounting means is only accessible from the interior of the housings of the first and second terminals.

3. An island payment terminal system, comprising:

first and second payment terminals, each payment terminal having a housing with a front surface, first and second side surfaces, rear surface, and first and second contact surfaces, the housing substantially L-shaped for the entire height thereof, and wherein the first and second contact surfaces comprising the recessed portion of the L-shaped housing;

support means for supporting the first and second payment terminals, the support means having at least first and second surfaces for partial engagement with the first or second contact surface of the first terminal and with the first or second surface of the second contact surface of the second terminal; and mounting means for mounting the first and second payment terminals to the support means such that the front surfaces of the terminals face in opposite directions.

4. The system of claim 3, wherein the support means comprises an elongated pole having a rectangular cross-section and having first and second sets of opposing surfaces, and wherein the first and second engagement surfaces comprises one of the sets of opposing surfaces.

5. The system of claim 4, wherein the cross-section of the pole is square.

6. The system of claim 3, wherein the support means includes first and second opposing ends, the system further comprising:

a substantially horizontal stationary surface, the support means rigidly connected to the horizontal surface at its first end.

7. The system of claim 6, wherein the housing of each terminal further comprises a bottom surface, the bottom surface of each terminal contacting the stationary surface when mounted to the support means, such that the weight of each terminal is substantially supported by the stationary surface.

8. The system of claim 6, further comprising a ceiling and wherein the second end of the support means is affixed to the ceiling.

9. The system of claim 3, wherein each payment terminal comprises:

means for receiving currency;

means for reading a debit or credit card; and means for printing a receipt, the currency receiving means, card reading means and receipt printing means residing substantially within the interior of the housing and accessible at the front surface of the terminal.

10. The system of claim 3, wherein each terminal comprises an aperture through one of the contact surfaces thereof, and wherein the mounting means comprises:

first and second opposing holes through opposing sides of the support means; and a fastener for placement through the first and second opposing holes and through the apertures of both the first and second payment terminals.

11. In an island automated attendant system comprising first and second attendant terminals and a support means to which the first and second attendant terminals are mounted, the improvement comprising:

each terminal having a substantially L-shaped housing having front, first and second side, rear, and first and second contact surfaces, the first and second contact surfaces comprising the recessed portion of the L-shaped housing, such that at least a portion of either the first or second contact surfaces of both the first and second terminals contact the support means when mounted.

12. The system of claim 11, wherein the support means comprises first and second opposing surfaces, such that the first contact surface of the first terminal contacts the first opposing surface of the support means and the first contact surface of the second terminal contacts the second opposing surface of the support means when mounted.

13. The system of claim 11, wherein the support means comprises first and second opposing surfaces, such that the second contact surface of the first terminal contacts the first opposing surface of the support means and the second contact surface of the second terminal contacts the second opposing surface of the support means when mounted.

14. The system of claim 11, wherein the support means comprises first, second, third and fourth surfaces, the first and second surfaces opposing each other and the third and fourth surfaces opposing each other, such that the first contact surface of the first terminal contacts the first surface of the support means, the first contact surface of the second terminal contacts the second surface of the support means, the second contact surface of the first terminal contacts the third surface of the support means, and the second contact surface of the second terminal contacts the fourth surface of the support means when mounted.

15. An automated attendant system comprising:

first and second automated terminals in proximity to each other, the first and second automated terminals each comprising an housing having a front surface, a first contact surface and a second contact surface, the first and second contact surfaces intersecting for the entire height of the first and second automated terminals to form a recessed portion of the housing;

support means for supporting the first and second automated terminals, the support means having at least first and second engagement surfaces in partial engagement with the first or second contact surface of the first terminal and with the first or second surface of the second contact surface of the second terminal; and mounting means for mounting the first and second terminals to the support means such that the front surfaces of the housings of the terminals face in opposite directions.

16. The automated attendant system of claim 15 wherein the first and second contact surfaces are non-linear.

17. The automated attendant system of claim 15 wherein the engagement surfaces of the support means are non-linear.

* * * * *